US007258434B2

(12) United States Patent
Smith et al.

(10) Patent No.: US 7,258,434 B2
(45) Date of Patent: Aug. 21, 2007

(54) INKJET PRINTHEADS HAVING MULTIPLE LABEL PLACEMENT POSITIONS FOR AIR DIFFUSION VENTS

(75) Inventors: Brian D. Smith, Fort Collins, CO (US); David E. Greer, Lexington, KY (US); Sara M. Coneway, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 324 days.

(21) Appl. No.: 10/720,353

(22) Filed: Nov. 24, 2003

(65) Prior Publication Data

US 2005/0110851 A1 May 26, 2005

(51) Int. Cl.
*B41J 2/175* (2006.01)
*B41J 2/17* (2006.01)

(52) U.S. Cl. ..... 347/87; 347/84; 347/86

(58) Field of Classification Search ..... 347/85, 347/86, 87, 84

See application file for complete search history.

(56) References Cited

U.S. PATENT DOCUMENTS 4,639,748 A 1/1987 Drake et al.
5,444,474 A 8/1995 Ohtsubo et al.
5,521,624 A 5/1996 Matsuda et al.
5,600,358 A 2/1997 Baldwin et al.
5,629,728 A 5/1997 Karita et al.
5,661,510 A 8/1997 Brandon et al.
5,847,735 A 12/1998 Betschon
5,867,187 A 2/1999 Toniolo
5,875,615 A 3/1999 Ito et al.
5,992,988 A 11/1999 Haigo
D431,833 S 10/2000 Umemura
6,164,770 A 12/2000 Takata
6,176,573 B1 1/2001 Barth et al.
6,227,653 B1 5/2001 Silverbrook
6,247,792 B1 6/2001 Silverbrook
6,247,804 B1 * 6/2001 Watanabe ..... 347/86
6,273,562 B1 8/2001 Deshmukh
6,276,786 B1 * 8/2001 Eida et al. ..... 347/86
6,280,024 B1 8/2001 Miyazawa et al.
6,302,532 B1 10/2001 Ishinaga et al.
6,332,676 B1 12/2001 Santhanam
6,378,998 B2 4/2002 Lim et al.
6,394,593 B1 5/2002 Komplin et al.
6,416,152 B1 * 7/2002 Matsuzaki et al. ..... 347/19
6,457,819 B2 10/2002 Santhanam
6,474,802 B1 11/2002 Lui (Continued)

*Primary Examiner*—Stephen Meier
*Assistant Examiner*—Rene Garcia, Jr.
(74) *Attorney, Agent, or Firm*—King & Schickli, PLLC

(57) ABSTRACT

The invention teaches placing labels over air diffusion vents on inkjet printheads depending upon a content of the inkjet printhead. In one embodiment, the inkjet printhead contains one or three inks in its interior and has three air diffusion vents in a lid that fluidly communicate with the interior. If the interior has one ink, a label covers the entirety of two of the three air diffusion vents to substantially prevent the two air diffusion vents from communicating with atmosphere. If the interior has three inks, a label only covers a portion of each of the three air diffusion vents and allows each to fluidly communicate with atmosphere. In this manner, single or tri-color inkjet printhead manufacturing can occur with a single lid having a multiplicity of label placement positions. The labels can have similar dimensions, dissimilar length dimensions or other.

13 Claims, 5 Drawing Sheets

U.S. PATENT DOCUMENTS 6,739,711 B2 * 5/2004 Lee et al. ..... 347/87
6,848,776 B2 * 2/2005 Nishioka et al. ..... 347/86
6,969,163 B2 * 11/2005 Studer et al. ..... 347/86
2001/0006397 A1 7/2001 Lim et al.
2001/0026305 A1 * 10/2001 Shinada et al. ..... 347/86
2002/0005883 A1 1/2002 Santhanam
2002/0044184 A1 * 4/2002 Kobayashi et al. ..... 347/86
2002/0158949 A1 * 10/2002 Ujita et al. ..... 347/86
2002/0196317 A1 * 12/2002 Santhanam et al. ..... 347/85

* cited by examiner

INKJET PRINTHEADS HAVING MULTIPLE LABEL PLACEMENT POSITIONS FOR AIR DIFFUSION VENTS

FIELD OF THE INVENTION

The present invention relates generally to inkjet printheads. In particular, it relates to covering air diffusion vents of the printheads with labels positioned in a variety of placement positions. In one aspect, it relates to placement positions depending upon a content of the inkjet printhead. In another aspect, it relates to placement positions according to label dimensions.

BACKGROUND OF THE INVENTION

The art of inkjet printhead manufacturing is well known. In general, a printhead has a housing or body that defines an interior filled with one or more inks. To prevent enormous pressure build-up during printing, each compartment contains a lung or a foam insert and an air diffusion vent that fluidly communicates the interior to atmospheric pressure. Often times, the air diffusion vent embodies a circuitous or torturous path in the form of a serpentine channel that snakes from a hole fluidly connected to the interior, and formed through a thickness of the housing, to a terminal end thereof. A label, or other covering, typically lays over the hole and portions of the air diffusion vent, but not the terminal ends, to slow the effects of ink evaporation.

Yet, depending upon the printhead type or content, e.g., single ink or multicolored, the number and placement of air diffusion vents for the housing of any given printhead changes. Thus, no commonality exists in the housing design which further prevents commonality from existing in the placement position and dimensions of the label over the air diffusion vents. This increases manufacturing costs.

Accordingly, the art of printhead manufacturing has a need for minimizing manufacturing costs, especially a need for a common printhead housing and label placement scheme regardless of content or type.

SUMMARY OF THE INVENTION

The above-mentioned and other problems become solved by applying the principles and teachings associated with the hereinafter described inkjet printheads having multiple label placement positions for attendant air diffusion vents.

Specifically, the present invention teaches methods, and the resultant apparatus, for placing labels over air diffusion vents on inkjet printheads depending upon a content of the inkjet printhead. In one embodiment, the inkjet printhead has a body containing a single ink in its interior. Its lid, which adheres to the body, has three air diffusion vents that fluidly communicate with the interior to alleviate backpressure build-up during use. In a first label placement position, a label covers the entirety of two of the three air diffusion vents to substantially prevent the two air diffusion vents from communicating with atmosphere. In another embodiment, the interior has three inks. In a second label placement position, a label only covers a portion of each of the three air diffusion vents and allows each to fluidly communicate with atmosphere. In this manner, only a single lid is required for manufacturing single or tri-color inkjet printheads thereby saving on manufacturing costs.

In further embodiments, the labels themselves have similar dimensions or dissimilar length dimensions. If similar, the label covers some or none of the air diffusion vents by positioning the label in one of two positions adjusted from one another along an axial length of the lid. If dissimilar, the label covers some or none of the air diffusion vents according to the length dimension of the label.

In still other embodiments, the label embodies a two layer laminate structure with a layer of polyester over a layer of polypropylene. The label preferably adheres to a top surface of the lid and the air diffusion vents include serpentine channels formed therein. Inkjet printers are also disclosed for housing the inkjet printheads.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained according to the methods and apparatuses particularly pointed out in the appended claims.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized and that process or other changes may be made without departing from the scope of the present invention. The following detailed description is, therefore, not to be taken in a limiting sense, and the scope of the present invention is defined only by the appended claims and their equivalents. In accordance with the present invention, methods and apparatus are hereinafter described for inkjet printheads having multiple label placement positions for attendant air diffusion vents regardless of printhead content or type.

Figure 7:
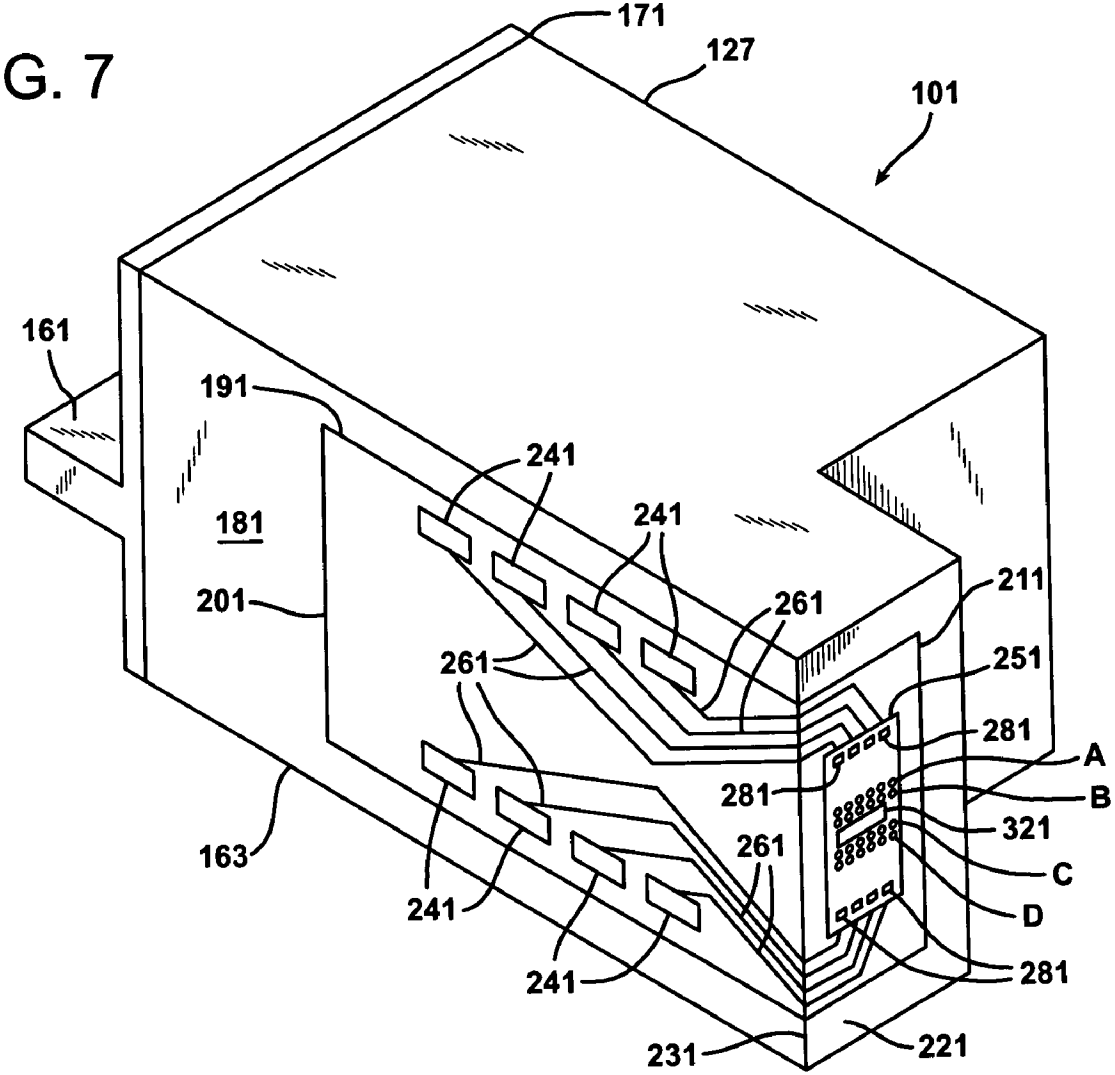
FIG. 7 is a perspective view in accordance with the present invention of an inkjet printhead assembled with a label positioned in one of a variety of placement positions.

With reference to FIG. 7, an inkjet printhead according to one embodiment of the present invention assembled with a label positioned in one of a multiplicity of placement positions is shown generally as 101. The printhead 101 has a housing 127 formed of a lid 161 and a body 163 assembled together through attachment or connection of a lid bottom surface and a body top surface at interface 171. The shape of the housing varies and depends upon the external device that carries or contains the printhead, the amount of ink to be contained in the printhead and whether the printhead contains one or more varieties of ink. In any embodiment, the housing or body has at least one compartment in an interior thereof for holding an initial or refillable supply of ink and a structure, such as a foam insert, lung or other, for maintaining appropriate backpressure in the inkjet printhead during use. In one embodiment, the internal compartment includes three chambers for containing three supplies of ink, especially cyan, magenta and yellow ink. In other embodiments, the compartment contains black ink, photo-ink and/or plurals of cyan, magenta or yellow ink. It will be appreciated that fluid connections (not shown) may exist to connect the compartment(s) to a remote source of bulk ink.

A portion 191 of a tape automated bond (TAB) circuit 201 adheres to one surface 181 of the housing while another portion 211 adheres to another surface 221. As shown, the two surfaces 181, 221 exist perpendicularly to one another about an edge 231.

The TAB circuit 201 has a plurality of input/output (I/O) connectors 241 fabricated thereon for electrically connecting a heater chip 251 to an external device, such as a printer, fax machine, copier, photo-printer, plotter, all-in-one, etc., during use. Pluralities of electrical conductors 261 exist on the TAB circuit 201 to electrically connect and short the I/O connectors 241 to the bond pads 281 of the heater chip 251 and various manufacturing techniques are known for facilitating such connections. It will be appreciated that while eight I/O connectors 241, eight electrical conductors 261 and eight bond pads 281 are shown, any number are embraced herein. It is also to be appreciated that such number of connectors, conductors and bond pads may not be equal to one another.

The heater chip 251 contains at least one ink via 321 that fluidly connects to a supply of ink in an interior of the housing. Typically, the number of ink vias of the heater chip corresponds one-to-one with the number of ink types contained within the housing interior. The vias usually reside side-by-side or end-to-end. During printhead manufacturing, the heater chip 251 preferably attaches to the housing with any of a variety of adhesives, epoxies, etc. well known in the art. As shown, the heater chip contains four rows (rows A-row D) of resistive heating elements, or heaters. For simplicity in this crowded figure, dots depict the heaters in the rows and typical printheads contain hundreds of heaters. It will be appreciated that the heaters of the heater chip preferably become formed as a series of thin film layers made via growth, deposition, masking, photolithography and/or etching or other processing steps. A nozzle plate, not shown, with pluralities of nozzle holes adheres over or is fabricated with the heater chip during thin film processing such that the nozzle holes align with the heaters for ejecting ink during use.

Figure 8:
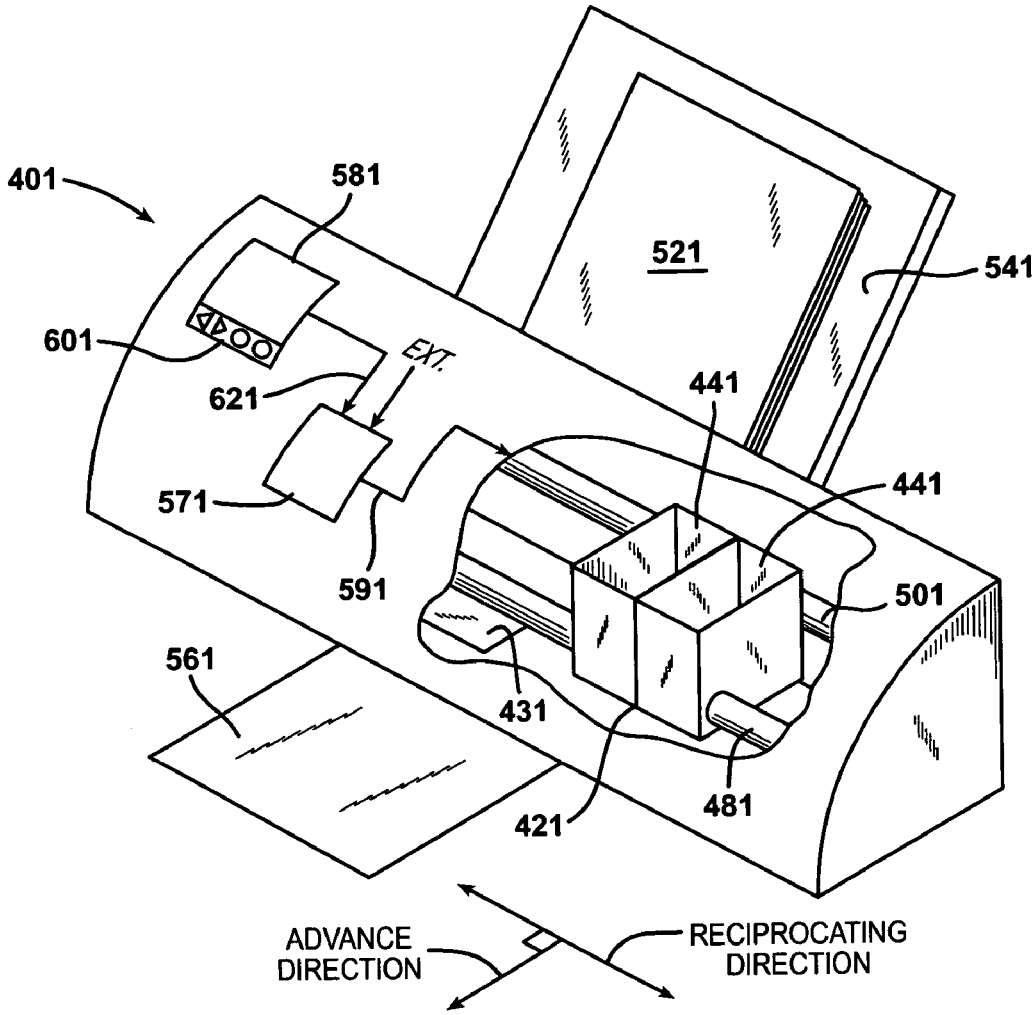
FIG. 8 is a perspective view in accordance with the present invention of an inkjet printer for housing an inkjet printhead assembled with a label positioned in one of a variety of placement positions.

With reference to FIG. 8, an external device in the form of an inkjet printer, for containing the printhead 101, is shown generally as 401. The printer 401 includes a carriage 421 having a plurality of slots 441 for containing one or more printheads. The carriage 421 is caused to reciprocate (via an output 591 of a controller 571) along a shaft 481 above a print zone 431 by a motive force supplied to a drive belt 501 as is well known in the art. The reciprocation of the carriage 421 is performed relative to a print medium, such as a sheet of paper 521, that is advanced in the printer 401 along a paper path from an input tray 541, through the print zone 431, to an output tray 561.

In the print zone, the carriage 421 reciprocates in the Reciprocating Direction generally perpendicularly to the paper Advance Direction as shown by the arrows. Ink drops from the printheads are caused to be ejected from the heater chip 251 (FIG. 7) at such times pursuant to commands of a printer microprocessor or other controller 571. The timing of the ink drop emissions corresponds to a pattern of pixels of the image being printed. Often times, such patterns are generated in devices electrically connected to the controller (via Ext. input) that are external to the printer such as a computer, a scanner, a camera, a visual display unit, a personal data assistant, or other. A control panel 581 having user selection interface 601 may also provide input 621 to the controller 571 to enable additional printer capabilities and robustness.

To print or emit a single drop of ink, the heaters (the dots of rows A-D, FIG. 7) are uniquely addressed with a small amount of current to rapidly heat a small volume of ink. This causes the ink to vaporize in a local ink chamber and be ejected through the nozzle plate towards the print medium.

As described herein, the term inkjet printhead may alternatively include piezoelectric technology, or other, and may embody a side-shooter structure instead of the roof-shooter structure shown.

Figure 1:
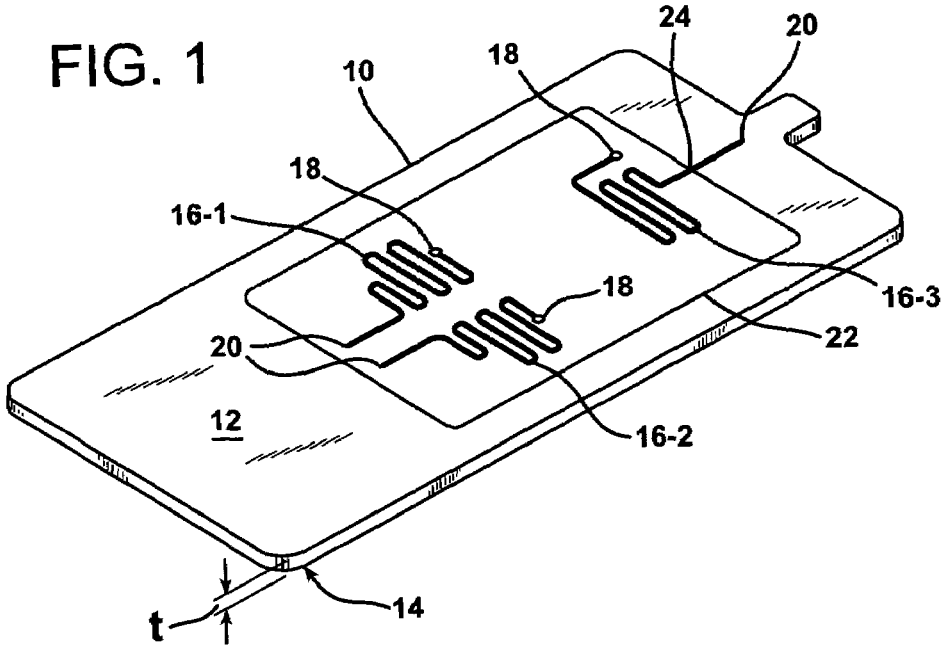
FIG. 1 is a perspective view in accordance with the present invention of an inkjet printhead lid having a label in a first label placement position.

With reference to FIG. 1, in a top perspective view of an inkjet printhead of the present invention, a lid 10 (alternatively: lid 161, FIG. 7) has a thickness, t, defined between a top surface 12 and a generally parallel bottom surface 14. In one embodiment, three air diffusion vents 16-1, 16-2, 16-3, reside in the top surface and embody serpentine channels cut to a desired depth in the lid thickness. They snake from an ink fill hole 18 at one terminal end thereof to a termination point 20 at the other terminal end. In other embodiments, the air diffusion vents exist in numbers other than three and reside in any portion of the inkjet printhead housing including the body and/or combinations of the body and lid. Each of the ink fill holes extends completely through the lid from the top to the bottom surface to create a fluid connection between the interior of the inkjet printhead and the air diffusion vent. In this manner, the interior of the printhead can vent to atmosphere to prevent backpressure build-up during use. Although not shown, the cross-section of the ink fill hole preferably comprises a substantially cylindrical cross-section having constant area.

In a first label placement position, a label 22 adheres or attaches to the top surface of the lid with a suitable epoxy or other adhesive. From the figure, those skilled in the art should observe the label in this position covers or resides over an entire length or entirety of the air diffusion vents 16-1, 16-2 but only covers a portion (between the ink fill hole 18 and point 24) of the air diffusion vent 16-3. As a result, the air diffusion vents 16-1, 16-2 cannot fluidly communicate or are prevented from fluidly communicating with atmospheric pressure during use while the air diffusion vent 16-3 is allowed fluid communication with atmosphere because its terminal end is exposed thereto. As a representative example, a manufacturer would place the label in this position if it needed a single air diffusion vent to fluidly communicate with atmosphere such as when the inkjet printhead contains an ink(s) in its interior, e.g., a single or mono-colored ink, less in number than the number of air diffusion vents.

Figure 2:
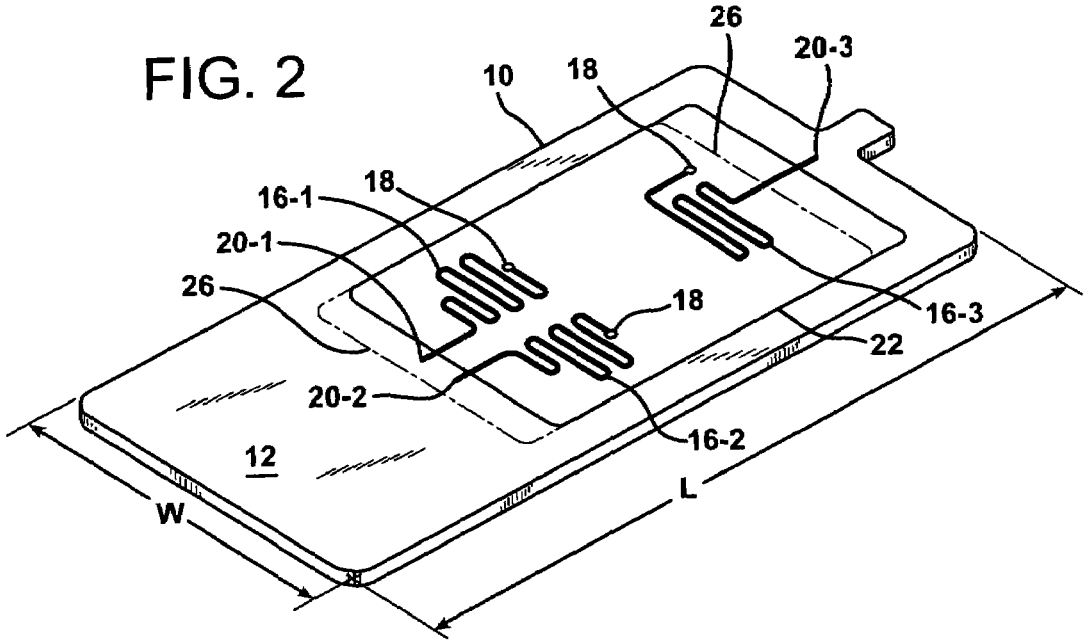
FIG. 2 is a perspective view in accordance with the present invention of an inkjet printhead lid having a label in a second label placement position.

In a second label placement position (FIG. 2), the label 22 is moved relative to the first label placement position (shown as dashed line 26) a sufficient distance along the axis of length dimension, L, of the top surface of printhead lid 10 to expose or uncover the terminal ends 20-1 and 20-2 of the air diffusion vents 16-1 and 16-2, respectively, while still maintaining the terminal end 20-3 of the air diffusion vent 16-3 in an exposed-to-atmosphere condition. A manufacturer would place the label in this position if it needed to fluidly communicate three air diffusion vents with atmosphere such as when an inkjet printhead content includes tri-color inks, such as cyan, magenta and yellow.

In other embodiments, the label may become positioned such that the terminal ends 20-1 and 20-2 are exposed while an entirety of the air diffusion vent 16-3 is covered. A manufacturer would consider this position if the inkjet printhead contents only included two inks, for example. In still other embodiments, the air diffusion vents exist two or more in number and the label becomes placed to allow all or less than all of them to fluidly communicate with atmosphere. Alternatively, the label becomes placed to prevent some or none of the air diffusion vents from fluidly communicating with atmosphere.

At this point, skilled artisans should appreciate that no matter what the contents of the inkjet printhead include, e.g., a single or a multiplicity of inks, a lid having multiple air diffusion vents can have multiple label placement positions to cause varieties of the air diffusions vents to fluidly communicate with atmosphere or not. In this manner, an inkjet printhead can have a common housing, regardless of content, and still have relatively simple manufacturing processes. In turn, manufacturers save on costs. In addition, skilled artisans should appreciate that a placement position of prior art labels occurred as a single predetermined design point, having some given manufacturing tolerance, such that labels on sequentially manufactured printheads allowed all of the air diffusion vents to communicate with atmosphere although each individual label might not have become positioned in the same exact relative position. In contrast, the first and second placement positions of the present invention are multiple predetermined design points, not merely slop-induced tolerance positions, which enable labels to become selectively placed in such a manner on the printhead to cover or not the entirety of some of the air diffusion vents.

Figure 3:
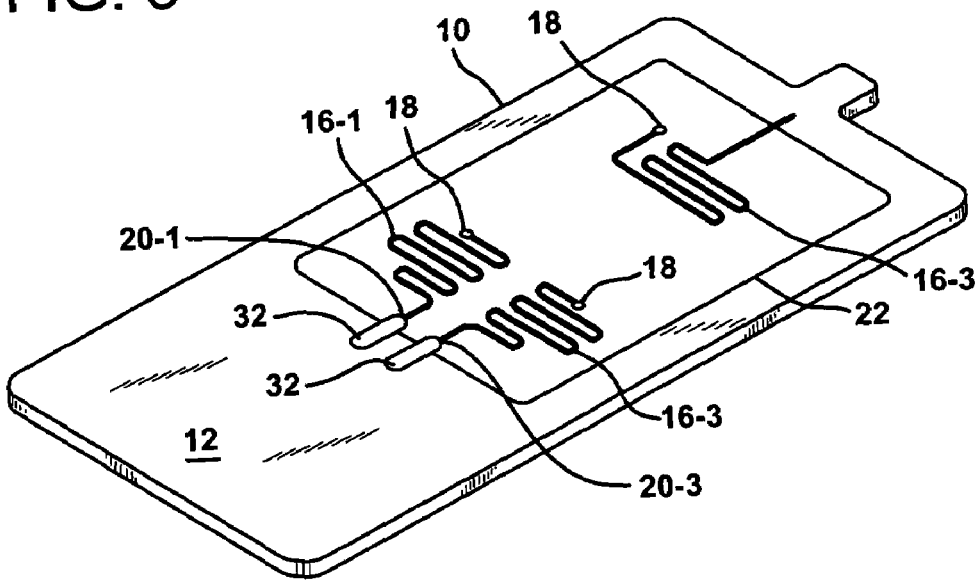
FIG. 3 is a perspective view in accordance with the present invention of an inkjet printhead lid having a label over an alternate embodiment of air diffusion vents.

In other embodiments, with reference to FIG. 3, the air diffusion vents may additionally have an end portion 32 occupying that area of the lid generally adjacent the terminal end 20-1, 20-3, for example, of the air diffusion vents to nullify label placement errors. As shown, the end portions embody generally oval shaped troughs and the label resides over some part thereof.

Figure 4:
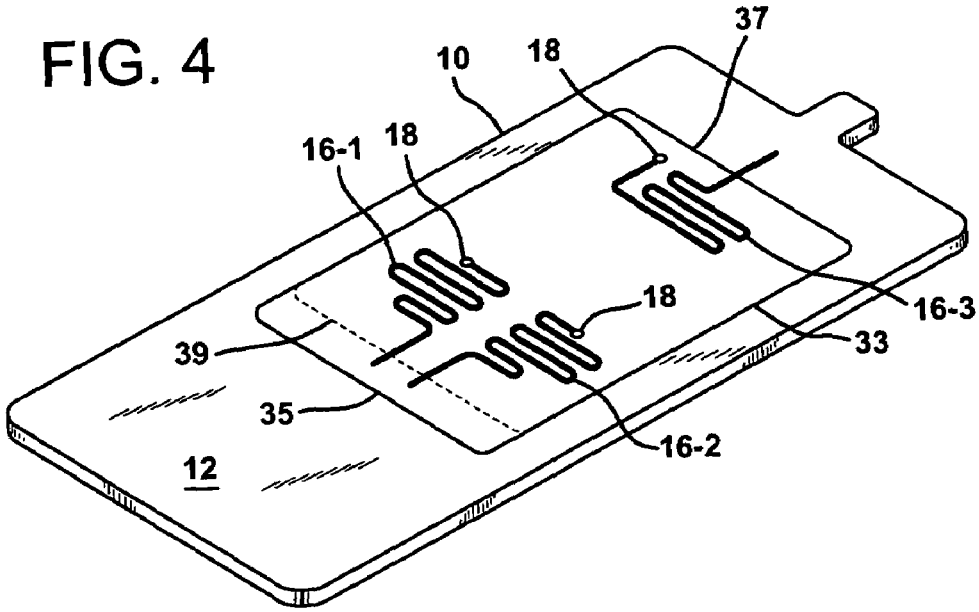
FIG. 4 is a perspective view in accordance with the present invention of an inkjet printhead lid having two label placement positions based upon a label having dissimilar length dimensions.

In FIG. 4, the label 33 covering the entirety of some or none of the air diffusion vents 16, may have a first length dimension, as between ends 35 and 37, or a second length dimension as between ends 39 (dashed line) and 37. With the longer of the two length dimensions, the label covers an entirety of air diffusion vents 16-1, 16-2 and prevents them from fluidly communicating with atmosphere. With the shorter of the two length dimensions, the label allows all three air diffusion vents 16-1, 16-2, 16-3 to fluidly communicate with atmosphere. Although this embodiment achieves printhead manufacturing by placing labels having dissimilar length dimensions in first or second placement positions, such represents a relatively inexpensive manufacturing alternative to having multiple lid designs with different numbers of air diffusion vents, according to a contents of the inkjet printhead, and having multiple-sized labels thereon.

Figure 5:
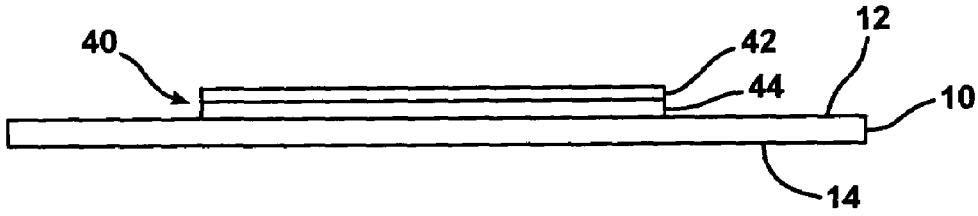
FIG. 5 is a side view in accordance with the present invention of an inkjet printhead lid and a two layer label for covering air diffusion vents.

In FIG. 5, the label 40 covering the air diffusion vents of the printhead lid 10 preferably embodies a two layer laminate structure having a first layer 42 over a second layer 44. In one embodiment, the first layer represents a composition of polyester in a thickness of about 0.001 inches while the second layer represents a composition of polypropylene in a thickness of about 0.0026 inches. In any instance, the second or bottom layer preferably adheres to the top surface of the lid 10 with an adhesive, epoxy or other or by a self-sticking composition compatible with a composition of the top surface. Other label considerations include selecting a label having superior moisture barrier characteristics and such may exist in a single layer label or in a multilayer label having two or more layers.

Figure 6A:
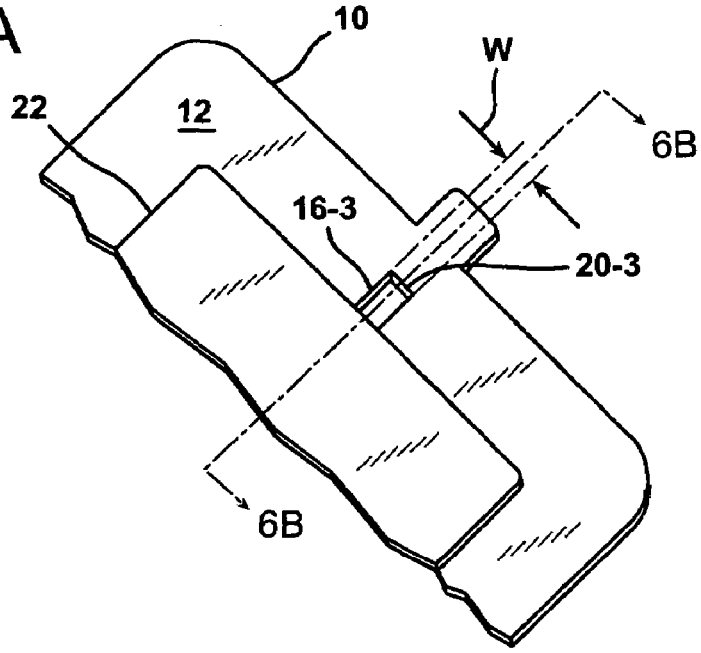
FIG. 6*a* is a partial perspective view in accordance with the present invention of an inkjet printhead lid and a label over a portion of an air diffusion vent.
Figure 6B:
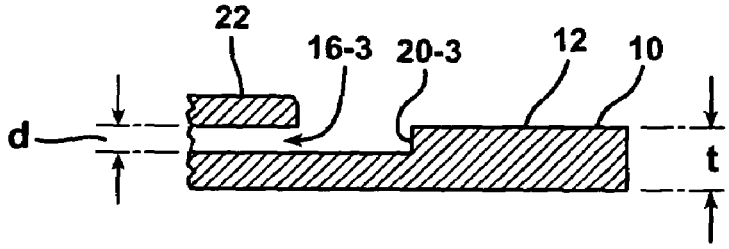
FIG. 6*b* is a cross-section view in accordance with the present invention of the inkjet printhead lid of FIG. 6*a* taken along line 6*b*-6*b;*

As seen in FIGS. 6*a* and 6*b*, the representative dimensions of the air diffusion vent 16-3 relative to the lid 10 include a channel depth, d, extending downward from the lid top surface 10 of about 0.5 mm and a channel width, w, of about 0.5 mm. The entire length, l, of the air diffusion vent (as between ink fill hole 18 and terminal end 20, FIG. 1, for example) is about 42 mm. As an optimum design point, the air diffusion vent will have a numerical figure of about 168 when dividing the length of the air diffusion vent by an area of the terminal end, e.g., the width multiplied by the depth. Mathematically, the equation becomes $l/(w \times d)$ and the units correspond to (l/mm). The lid has a thickness, t, of about 2 mm. Its length, L, and width, W, (FIG. 2), are about 50-60 mm and about 25 mm, respectively. In another embodiment, the label 22 does not completely fill the depth of the air diffusion vent after manufacturing completion. It may, however, fill the depth to some degree provided it does not choke off the fluid communication capabilities thereof.

The foregoing description is presented for purposes of illustration and description of the various aspects of the invention. The descriptions are not intended to be exhaustive or to limit the invention to the precise form disclosed. For example, other disassembled components may include laser printheads instead of the described inkjet printhead. Nonetheless, the embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. An inkjet printhead, comprising:

a plurality of air diffusion vents; and a label positioned over an entirety of at least one of said air diffusion vents during printing, said label being positioned over a portion but not an entirety of another of said air diffusion vents during printing.

2. The inkjet printhead of claim 1, wherein said plurality of air diffusion vents reside in a top surface of an inkjet printhead lid.

3. An inkjet printhead, comprising:

an interior;

at least two air diffusion vents in fluid communication with said interior; and a label positioned over an entirety of at least one of said at least two air diffusion vents during printing to prevent said at least one air diffusion vent from being in fluid communication with atmosphere, said label being positioned over a portion but not an entirety of another of said at least two air diffusion vents whereby said interior is in fluid communication with atmosphere during printing.

4. An inkjet printhead, comprising: a surface with a plurality of air diffusion vents, said surface having at least two predetermined label placement positions; and a label on said surface positioned in one of said at least two predetermined label placement positions wherein said label is positioned over an entirety of at least one of said plurality of air diffusion vents thereby preventing fluid communication with atmosphere and over a portion but not an entirety of another of said plurality of air diffusion vents for fluid communication with atmosphere during printing.

5. The inkjet printhead of claim 4, wherein said surface is a top surface of an inkjet printhead lid.

6. An inkjet printhead, comprising:

a body defining an interior;

a lid having a top and bottom surface, said bottom surface connected to said body, said top surface having more than one air diffusion vent and two predetermined label placement positions, each said air diffusion vent being in fluid communication with said interior; and a label adhered to said top surface of said lid and positioned in one of said two predetermined label placement positions such that said label is positioned over an entirety of at least one of said air diffusion vents thereby preventing fluid communication with atmosphere and over a portion but not an entirety of at least one other of said air diffusion vents placing said interior in fluid communication with atmosphere during printing.

7. The inkjet printhead of claim 6, wherein said each said air diffusion vent has a serpentine channel terminating in a hole extending through a thickness of said lid from said top surface to said bottom surface.

8. The inkjet printhead of claim 7, wherein a length of said serpentine channel divided by a width multiplied a depth of a terminal end of said serpentine channel is numerically about 168.

9. The inkjet printhead of claim 6, wherein said label is a two layer laminate.

10. The inkjet printhead of claim 9, wherein said label is a layer of polyester over a layer of polypropylene.

11. An inkjet printhead, comprising:

a plurality of ink fill holes;

a plurality of air diffusion vents, each fluidly connected to one of said ink fill holes; and a label positioned over an entirety of at least one of said air diffusion vents and one of said fluidly connected ink fill holes during printing, said label being positioned over a portion but not an entirety of another of said air diffusion vents during printing.

12. An inkjet printhead, comprising:

a surface with a plurality of air diffusion vents and fluidly connected ink fill holes, said surface having at least two predetermined label placement positions; and a label on said surface positioned in one of said at least two predetermined label placement positions wherein said label is positioned over an entirety of at least one of said air diffusion vents and one said fluidly connected ink fill hole during printing, said label being positioned over a portion but not an entirety of at least one other of said air diffusion vents to place the ink fill hole fluidly connected thereto in fluid communication with atmosphere during printing.

13. An inkjet printhead, comprising:

a body defining an interior;

a lid having a top and bottom surface, said bottom surface connected to said body, said top surface having more than one air diffusion vent and fluidly connected ink fill hole and two predetermined label placement positions, each said air diffusion vent being in fluid communication with said interior by said fluidly connected ink fill hole; and a label adhered to said top surface of said lid and positioned in one of said two predetermined label placement positions such that said label is positioned over an entirety of at least one of said air diffusion vents and fluidly connected ink fill holes and over a portion but not an entirety of at least one other of said air diffusion vents, placing said interior in fluid communication with atmosphere during printing.

* * * * *